US007679288B2

(12) United States Patent
Song et al.

(10) Patent No.: US 7,679,288 B2
(45) Date of Patent: Mar. 16, 2010

(54) PLASMA DISPLAY PANEL

(75) Inventors: Jung-Suk Song, Suwon-si (KR); Joon-Hyeong Kim, Suwon-si (KR)

(73) Assignee: Samsung SDI Co., Ltd., Maetan-dong, Yeongtong-gu, Suwon-si, Gyeonggi-do (KR)

( * ) Notice: Subject to any disclaimer, the term of this patent is extended or adjusted under 35 U.S.C. 154(b) by 378 days.

(21) Appl. No.: 11/727,905

(22) Filed: Mar. 28, 2007

(65) Prior Publication Data

US 2008/0042566 A1 Feb. 21, 2008

(30) Foreign Application Priority Data

Mar. 29, 2006 (KR) ..... 10-2006-0028281

(51) Int. Cl.
*H01J 17/00* (2006.01)

(52) U.S. Cl. ..... 313/582

(58) Field of Classification Search ..... None
See application file for complete search history.

(56) References Cited

U.S. PATENT DOCUMENTS

| | | | | |
|---|---|---|---|---|
| 3,778,126 | A * | 12/1973 | Wilson | 445/25 |
| 3,778,127 | A * | 12/1973 | Langston et al. | 445/25 |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Ashok Patel
(74) *Attorney, Agent, or Firm*—Robert E. Bushnell, Esq.

(57) ABSTRACT

A plasma display panel that includes a first substrate affixed to a second substrate, a plurality of discharge cells arranged between the first and the second substrates to define a display area, an exhaust aperture included in at least one of the first and the second substrates, frit arranged around the exhaust aperture, an application area of the frit being on a side of the exhaust aperture closest to the display area being less than an application area of the frit on a side of the exhaust aperture furthest from the display area and an exhaust tube attached, via said frit, to the at least one of the first and the second substrates to communicate with said exhaust aperture. The application area of the frit is skewed so as to minimize the occurrence of a stain in a portion of the display area near the exhaust aperture.

15 Claims, 4 Drawing Sheets

U.S. PATENT DOCUMENTS

| | | | | |
|---|---|---|---|---|
| 6,630,916 | B1 | 10/2003 | Shinoda | |
| 6,707,436 | B2 | 3/2004 | Setoguchi et al. | |
| 7,462,986 | B2 * | 12/2008 | Woo | 313/582 |

FOREIGN PATENT DOCUMENTS

| | | | |
|---|---|---|---|
| JP | 2845183 | | 10/1998 |
| JP | 2917279 | | 4/1999 |
| JP | 2001-043804 | | 2/2001 |
| JP | 2001-325888 | | 11/2001 |
| KR | 2004-0088754 | A | 10/2004 |
| KR | 2005-0079473 | A | 8/2005 |
| KR | 2005-0112252 | A | 11/2005 |
| KR | 2006-0026603 | A | 3/2006 |

* cited by examiner

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 29 Mar. 2006 and there duly assigned Serial No. 10-2006-0028281.

BACKGROUND OF THE INVENTION

1. Field of the Invention

The present invention relates to a plasma display panel and, more particularly, to a plasma display panel that can reduce an appearance of a stain around an exhaust aperture and an exhaust tube.

2. Description of the Related Art

Generally, a plasma display panel (PDP) is a display device that can display an image using red, green and blue visible light created by exciting phosphors using vacuum ultraviolet (VUV) rays emitted from plasma generated by a gas discharge. In an alternating current (AC) plasma display panel, address electrodes are formed on a rear substrate. The address electrodes are covered with a dielectric layer. Barrier ribs are arranged in a striped pattern on the dielectric layer between the address electrodes. Red, green and blue phosphor layers are formed on the barrier ribs. A plurality of display electrodes, each having a sustain electrode and a scan electrodes, are arranged on an inner surface of a front surface. The display electrodes extend in a direction intersecting the address electrodes. The display electrodes are covered with a dielectric layer and a MgO passivation layer. Discharge cells are formed at regions where the address electrodes formed on the rear substrate intersects the sustain and scan electrodes formed on the front substrate. Typically, millions of the discharge cells are arranged in a matrix pattern in the plasma display panel.

A memory property is used for driving the discharge cells of the plasma display panel. Describing in more detail, in order to generate a discharge between the sustain and scan electrodes, a potential difference higher than a threshold voltage is required. This threshold voltage is called a firing voltage (Vf). When scan and address voltages are respectively applied to the scan and address electrodes, a discharge is generated between the scan and address electrodes to create plasma in the discharge cell. Electrons and ions of the plasma travel to electrodes having polarities opposite to that of the electrons and ions.

Meanwhile, a dielectric layer is deposited on each electrode of the plasma display panel so that space charges can accumulated on the dielectric layer having an opposite polarity. As a result, since net space potential between the scan and address electrodes becomes lower than an initially applied address voltage (Va), the address discharge is weakened and disappears. At this point, a relatively small amount of electrons accumulates on the sustain electrodes and a relatively large amount of electrons accumulate on the scan electrodes. The charges accumulated on the dielectric layer covering the sustain and scan electrodes during the address discharge are called wall charges (Qw). A space voltage generated between the sustain and scan electrodes by the wall charges is called a wall voltage (Vw).

In a case where a discharge sustain voltage (Vs) is applied to the sustain and scan electrodes, when a sum (Vs+Vw) of the discharge sustain voltage (Vs) and the wall voltage (Vw) becomes higher than the firing voltage (Vf), a sustain discharge occurs in the discharge cells, thereby generating vacuum ultraviolet rays. The vacuum ultraviolet rays excite the corresponding phosphor layer to emit visible light through the transparent front panel.

However, when there is no address discharge between the scan and address electrodes (i.e., when no address voltage (Va) is applied), the wall charges do not accumulate between the sustain and scan electrodes. As a result, no wall voltage exist between the sustain and scan electrodes. At this point, only the discharge sustain voltage (Vs) applied between the sustain and scan electrodes. Since the discharge sustain voltage is lower than the firing voltage (Vf), the gas space defined between the sustain and scan electrodes cannot be discharged. In this way, only cells selected during the address discharge will produce a plasma during the sustain discharge.

The plasma display panel further includes an exhaust aperture and an exhaust tube that are provided at a portion of the rear substrate. The exhaust aperture and tube provide a passage through which an interior defined between front and rear substrates that are sealed together can be exhausted, after which discharge gas is injected. After the discharge gas is injected, an end of the exhaust tube is sealed to provide a sealing structure for the plasma display panel.

The exhaust tube is attached to the rear substrate by frit. That is, the melted frit is applied around the exhaust aperture of the rear substrate and the exhaust tube is attached to the melted frit. When the frit is cooled and solidified, the exhaust tube is securely attached around the exhaust aperture. When the exhaust tube is attached to the melted frit as described above, a portion of the frit is located inside of the exhaust tube and the rest of the frit is located outside of the exhaust tube.

The frit generates impurity gas as it is phase-changed from the high temperature melted state to the low temperature solid state. At this point, the impurity gas generated from the frit adjacent to a display area is absorbed in the display area. When the plasma display panel is driven, the absorbed impurity gas generates a stain around the exhaust aperture and the exhaust tube, thereby deteriorating the quality of the plasma display panel. Therefore, what is needed is an improved design for a plasma display panel that leads to a smaller sized stain in the display area.

SUMMARY OF THE INVENTION

It is therefore an object of the present invention to provide an improved design for a plasma display panel.

It is also an object of the present invention to provide for a design for a plasma display panel that reduces a stain size in the display area near the exhaust aperture caused by frit used to attach an exhaust tube to the display.

These and other objects can be achieved by a plasma display panel that includes a first substrate affixed to a second substrate, a plurality of discharge cells arranged between the first and the second substrates to define a display area, an exhaust aperture included in at least one of the first and the second substrates, frit arranged around the exhaust aperture, an application area of the frit being on a side of the exhaust aperture closest to the display area being less than an application area of the frit on a side of the exhaust aperture furthest from the display area and an exhaust tube attached, via said frit, to the at least one of the first and the second substrates to communicate with said exhaust aperture.

A center of the exhaust tube can be displaced from a center of the exhaust aperture by a distance. The center of the exhaust tube can be displaced from the center of the exhaust aperture in a direction away from the display area. The frit can be arranged in a donut-shape that surrounds the exhaust aperture. A first width between inner and outer circumferences of the frit on the side of the exhaust aperture nearest the display area can be less than a second width between the inner and outer circumferences of the frit on the side of the exhaust aperture furthest from the display area. The second width can be at least 1.3 times larger than the first width. The second width can be 8 mm. The first width can be 5 mm. A center of an inner circumference of the frit can coincide with a center of the exhaust aperture. A center of an outer circumference of the frit can be displaced from the center of the exhaust aperture in a direction away from the display area. A first distance between a line tangent to an inner circumference of the frit and a line tangent to an inner circumference of the exhaust tube at the side of the exhaust aperture closest to the display area can be less than a second distance between a line tangent to the inner circumference of the frit and a line tangent to the inner circumference of the exhaust tube at the side of the exhaust aperture furthest far away from the display area.

According to another aspect of the present invention, there is provided a plasma display panel that includes a first substrate affixed to a second substrate, a plurality of discharge cells arranged between the first and the second substrates to define a display area, an exhaust aperture included in at least one of the first and the second substrates, frit arranged around the exhaust aperture, an application area of the frit being of a shape that is adapted minimize a stain area produced by an application of said frit and an exhaust tube attached, via said frit, to said at least one of the first and second substrates to communicate with said exhaust aperture.

The application area of the frit about the exhaust aperture can have a shape of a skewed donut. The application area of the frit can be skewed in a direction away from the display area. A center of the exhaust aperture can coincide with a center of the inner circumference of the application area of the frit, and a center of the exhaust tube can coincide with a center of an outer circumference of the application area of the frit. The center of the outer circumference of the application area of the frit can be displaced a distance in a direction away from the display area from the center of the inner circumference of the application area of the frit.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
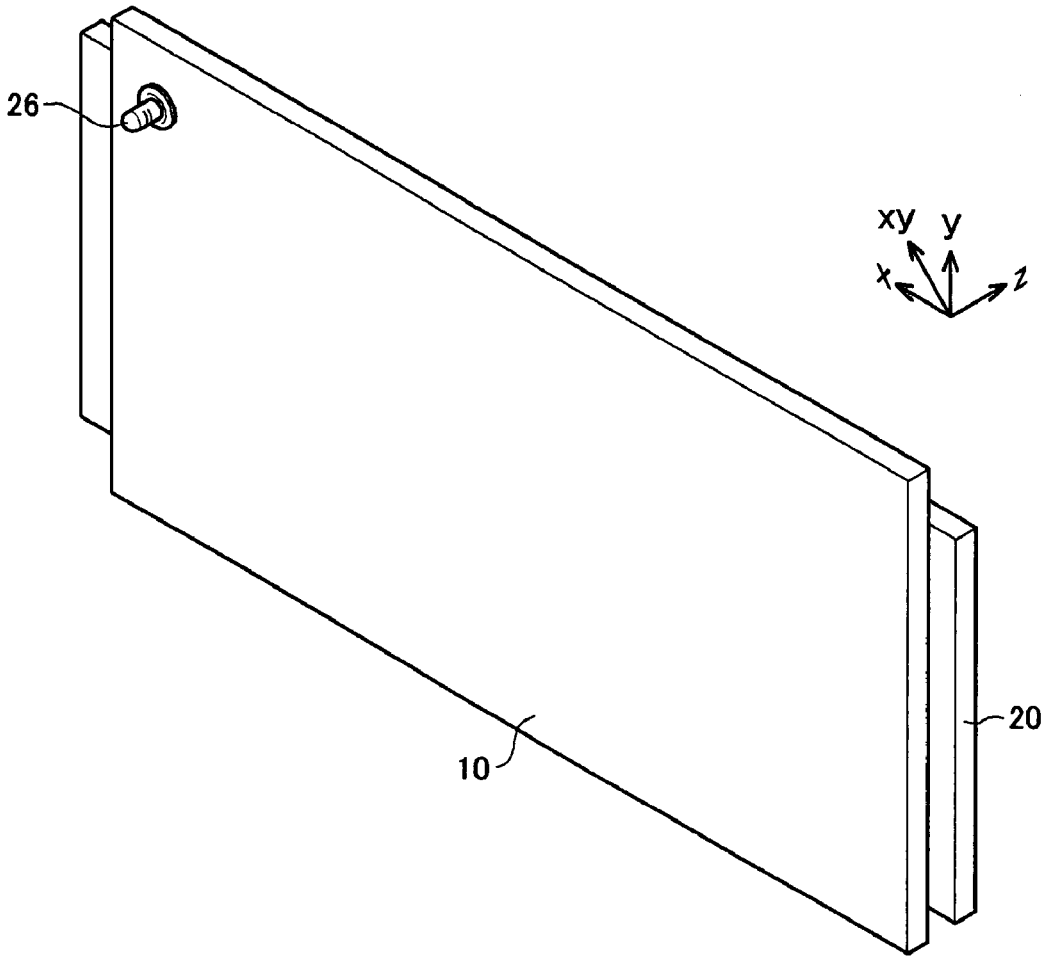
FIG. 1 is a rear perspective view of a plasma display panel according to an exemplary embodiment of the present invention.
Figure 2:
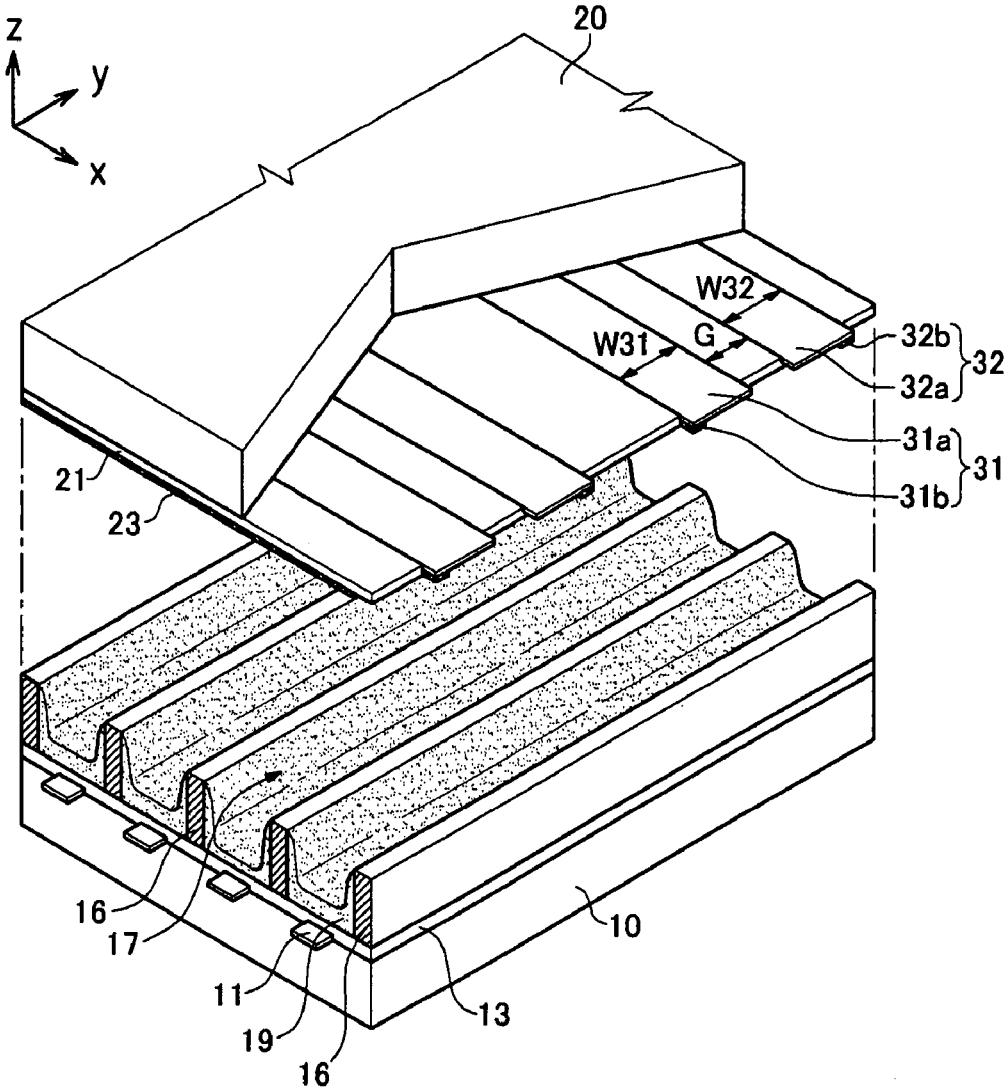
FIG. 2 is a partially exploded perspective view of a plasma display panel according to an exemplary embodiment of the present invention.

Turning now to the figures, FIG. 1 is a rear perspective view of a plasma display panel according to an exemplary embodiment of the present invention where the rear and front substrates 10 and 20 are shown as being directly sealed together and FIG. 2 is a partially exploded perspective view of a plasma display panel according to an exemplary embodiment of the present invention. Referring to FIGS. 1 and 2, a plasma display panel of this exemplary embodiment includes first and second substrates (hereinafter, "rear and front substrates") 10 and 20 facing each other at a predetermined interval and sealed together via a frit sealant 18 with barrier ribs 16 provided between the rear and front substrates 10 and 20. The barrier ribs 16 are formed to a predetermined height between the rear and front substrates 10 and 20 to define a plurality of discharge cells 17. A height (in the z direction) of the discharge cell 17 is much less than a width of each of the rear and front substrates 10 and 20. The discharge cells 17 are filled with a discharge gas (e.g., a mixture gas including neon (Ne) and xenon (Xe)) to produce vacuum ultraviolet rays via a gas discharge. The discharge cells 17 have phosphor layers 19 for emitting visible light by absorbing the vacuum ultraviolet rays.

In order to display an image via gas discharge, the plasma display panel includes address electrodes 11, first electrodes (hereinafter, "sustain electrodes") 31, and second electrodes (hereinafter, "scan electrodes") 32, all of which are arranged between the rear and front substrates 10 and 20 in response to the discharge cells 17. The address electrodes 11 are covered with a dielectric layer 13 deposited on an inner surface of the rear substrate 10. The dielectric layer 13 prevents the address electrodes 11 from being damaged by preventing positive ions or electrons from directly colliding with the address electrodes 11, and generates and accumulates wall charges therein. Since the address electrodes 11 are arranged on the rear substrate 10 so as not to interfere with the irradiation of the visible light toward the front substrate 20, the address electrodes 11 can be formed of a nontransparent material. For example, the address electrodes 11 can be formed of metal that has a high level of electric conductivity.

The barrier ribs 16 are provided on the first dielectric layer 13 to define the discharge cells 17. As an example, the barrier ribs 16 can be spaced apart from each other along a x direction and extend along the y direction to form the discharge cells in a striped pattern. When barrier ribs extending in the x direction are can also be formed between the barrier ribs 16 and extend along the y direction, the discharge cells can be formed in a matrix pattern. This matrix pattern structure is not illustrated in the drawings.

The phosphor layer 19 formed in each discharge cell 17 is formed by depositing fluorescent paste on a sidewall of the barrier ribs 16 and on a surface of the first dielectric layer 13 between the barrier ribs 16, and then drying and baking the deposited fluorescent paste. The phosphor layers 19 formed in the discharge cells 17 arranged along the y direction are formed of phosphors of an identical color. In addition, the phosphor layers 19 formed in the discharge cells 17 arranged along the x direction are formed of a repeating pattern of red, green, and blue phosphors R, G and B.

In addition, the sustain and scan electrodes 31 and 32 are provided on an inner surface of the front substrate 20 to form surface discharge structures corresponding to the respective discharge cells 17, which can induce the gas discharge in the discharge cells 17. The sustain and scan electrodes 31 and 32 extend along the x direction.

Each of the sustain and scan electrodes 31 and 32 includes a transparent electrode 31*a*, 32*a* respectively that generates the discharge and a bus electrode 31*b*, 32*b* respectively that applies a voltage signal to the transparent electrode 31*a*, 32*a*. The transparent electrodes 31*a* and 32*a* are portions where the surface discharge occurs in the discharge cells 17. The transparent electrodes 31*a* and 32*a* are formed of a transparent material such as indium tin oxide (ITO) to provide a sufficient aperture ratio for the discharge cells 17. The bus electrodes 31*b* and 32*b* are formed of metal having a high level of electric conductivity in order to compensate for the high electric resistance of the transparent electrodes 31*a* and 32*a*.

The transparent electrodes 31*a* and 32*a* have respective widths W31 and W32 in the y direction to form a surface discharge structure and a discharge gap G therebetween. The bus electrodes 31*b* and 32*b* are respectively arranged on the transparent electrodes 31*a* and 32*a* while extending along the x direction. Therefore, when the voltage signal is applied to the bus electrodes 31*b* and 32*b*, the voltage signal is applied to the transparent electrodes 31*a* and 32*a* connected to the respective bus electrodes 31*b* and 32*b*.

The sustain and scan electrodes 31 and 32 intersect the address electrodes 11 and face each other. The sustain and scan electrodes 31 and 32 are covered with a dielectric layer 21. The dielectric layer 21 protects the sustain and scan electrodes 31 and 32 from the gas discharge, and generates and accumulates wall charges therein. The dielectric layer 21 is covered with a passivation layer 23 formed of, for example, transparent MgO to protect the dielectric layer 21 and to increase a secondary electron emission coefficient.

When the plasma display panel is driven, a reset discharge occurs by a reset pulse applied to the scan electrodes 32 in a reset period. In an addressing period following the reset period, an address discharge occurs by the scan pulse applied to the scan electrodes 32 and an address pulse applied to the address electrodes 11. Next, in a sustain period, a sustain discharge occurs by a sustain pulse that is alternately applied to the sustain and scan electrodes 31 and 32.

The sustain and scan electrodes 31 and 32 function as electrodes that apply the sustain pulse required for the sustain discharge. The scan electrodes 32 function as electrodes that apply the reset and scan pulses. The address electrodes 11 function as electrode that apply the address pulse. The sustain, scan and address electrodes 31, 32 and 11 can vary their functions depending on voltage waveforms respectively applied thereto. Therefore, the functions are not limited to those described above.

The plasma display panel selects discharge cells 17 that will be turned during the sustain discharge by having an address discharge occur only in selected discharge cells. This address discharge occurs by the interaction between the address and scan electrodes 11 and 32. The selected discharge cells 17 are then driven during the sustain discharge by applying a voltage between the sustain and scan electrodes 31 and 32, thereby displaying an image.

Figure 4:
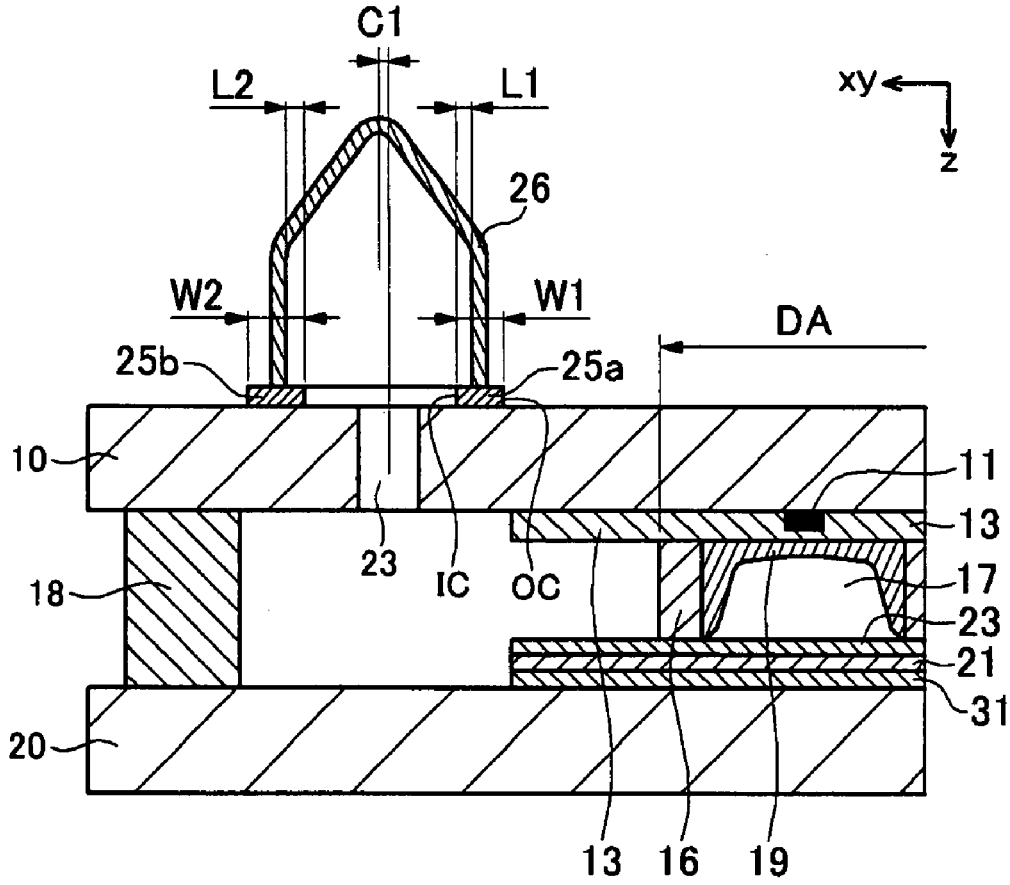
FIG. 4 is a sectional view taken along line IV-IV of FIG. 3.

Meanwhile, in a process for manufacturing the plasma display panel, air can remain in the discharge cells 17 between the front and rear substrates 20 and 10 that are sealed together by frit (18 in FIG. 4). The remaining air is exhausted through an exhaust tube 26 provided on the rear substrate 10. After the remaining air is exhausted, discharge gas is injected into the discharge cells 17 through the exhaust tube 26, after which an injection passage of the exhaust tube 26 is sealed, thereby completing the plasma display panel.

Figure 3:
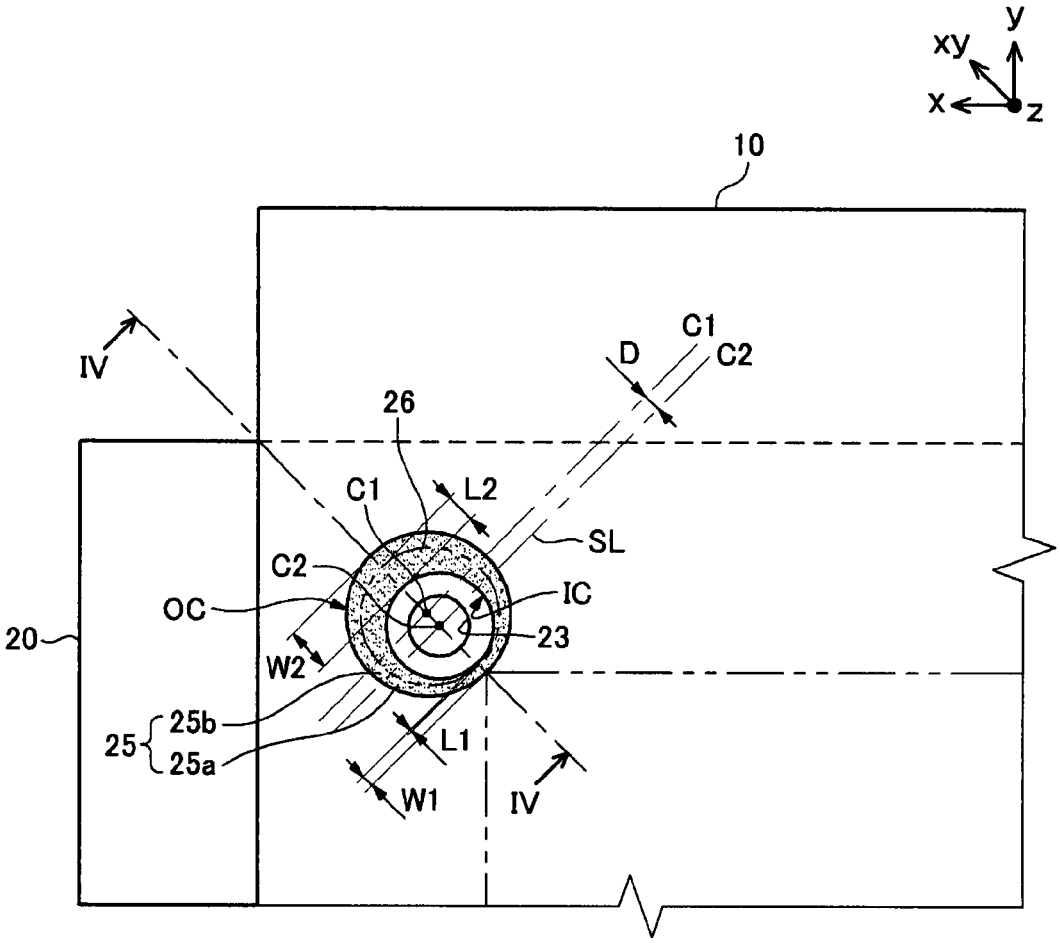
FIG. 3 is a schematic view illustrating an exhaust aperture, an exhaust tube, and a frit according to the present invention.

Turning now to FIGS. 3 and 4, FIG. 3 is a schematic view illustrating an exhaust aperture 23, an exhaust tube 26, and frit 25 (frit 25 applied to areas 25*a* and 25*b*) according to the present invention and FIG. 4 is a sectional view taken along line IV-IV of FIG. 3. Referring to FIGS. 3 and 4, the rear substrate 10 is provided with an exhaust aperture 23. The exhaust tube 26 is attached around the exhaust aperture 23 by frit 25.

The exhaust aperture 23 functions as a passage through which the discharge cells 17 that are formed between the front and rear substrates 20 and 10 of the display area DA can be connected to the outside of the display. The exhaust tube 26 is attached to an outer surface of the rear substrate 10 while surrounding the exhaust aperture 23. The exhaust tube 26 and the exhaust aperture 23 connect the discharge cells 17 of the display area DA to the outside of the display during the air exhaust and gas injection processes. When the injection of the discharge gas is completed, the exhaust tube 26 is sealed to isolate the discharge cells 17 of the display area DA from the outside. At this point, frit 25, that is at a high temperature melted state, is applied to the rear substrate 10 around the exhaust aperture 23 and is cooled and hardened to fix the exhaust tube 26 on the rear substrate 10. Meanwhile, the frit 25 is applied so that an application area of the frit at a portion of the exhaust aperture 23 closest to the display area DA is less than an application area of the frit at a portion of the exhaust aperture furthest from the display area DA. When it is assumed that the exhaust aperture 23 is formed at an outer region of a corner of the display area DA, the portion closest to the display area DA means a portion closest to the corner of display area DA, and the portion furthest from the display area DA means a portion furthest from the corner of the display area DA.

An application area for the frit 25 around the exhaust aperture 23 is divided into the region closest to the display area DA and the region furthest from the display area DA with reference to a straight line SL of FIG. 3. SL passes through center C2 of the exhaust aperture 23. A first region 25*a* indicates the application area of the frit at the region closest to the display area DA. In addition, a second region 25*b* indicates the application area of the frit at the region furthest from the display area DA. Second region 25*b* is on an opposite side of SL than first region 25*a*.

The frit 25 that is in the high temperature melted state generates an impurity gas and fixes the exhaust tube 26 while being cooled and solidified to a low temperature. The impurity gas generated from the application area of the frit close to the display area DA is absorbed by the display area DA. According to the present exemplary embodiment, since the application area 25*a* of the frit at the region closest to the display area DA is less than the application area 25*b* of the frit at the region furthest from the display area DA, the generation of the impurity gas from the application area 25*a* closest to the display area DA is reduced. Therefore, the stain appearance around the exhaust aperture 23 and the exhaust tube 26 is reduced and thus the display quality of the plasma display panel is improved by so designing the application area of the frit 25.

To this end, a center C1 of the exhaust tube 26 is displaced from the center C2 of the exhaust aperture 23 by a predetermined distance in a direction (an xy-direction) away from the display area DA. The frit 25 is formed in a donut-shape having inner and outer circumferences IC and OC. The first region 25*a* that is closest to the display area DA has a first width W1 between the inner and outer circumferences IC and OC. The second region 25*b* that is furthest from the display area DA has a second width W2 between the inner and outer circumferences IC and OC. In the present invention, the application area of the frit is designed so that the first width W1 is less than the second width W2 (i.e., W1<W2).

The first and second widths W1 and W2 are determined depending upon diameters and widths of the exhaust aperture 23 and the exhaust tube 26. By way of example, when the diameter of the exhaust aperture 23 is between 3 and 4 mm and the diameter of the exhaust tube 26 is between 5 and 7 mm, the second width W2 can be 1.3 times the first width W1

(i.e., W2=1.3×W1). That is, the second width W2 can be 8 mm while the first width W1 can be 5 mm.

A center of the inner circumference IC of the frit 25 coincides with the center C2 of the exhaust aperture 23. A center of the outer circumference OC of the frit 25 is identical to the center C1 of the exhaust tube 26. That is, the center C1 of the outer circumference OC of the frit 25 is shifted from the center C2 of the inner circumference of the frit 25 by a predetermined distance in the direction (the xy-direction) away from the display area DA.

Meanwhile, a first distance L1 between a line tangent to the inner circumference IC of the frit 25 and a line tangent to an inner circumference of the exhaust tube 26 in the first region 25*a* of the frit 25 is less than a second distance L2 between a line tangent to the inner circumference IC of the frit 25 and a line tangent to the inner circumference of the exhaust tube 26 at the second region 25*b* of the frit 25 (i.e., L1<L2). As a result, an area of the first region 25*a* of the frit 25 becomes less than that of the second region 25*b* (i.e., $A_{25a}<A_{25b}$). Accordingly, an amount of impurity gas generated in the first region 25*a* of the frit 25 is less than an amount of impurity gas generated in the second region 25*b* of the frit 25. That is, since the impurity gas causing the appearance of the stain on the corner of the display area DA is primarily caused by frit 25 applied to the first region 25*a*, an area of the stain appearance can be reduced by reducing the area of the first region 25*a*.

Although exemplary embodiments of the present invention have been described in detail herein above, it should be clearly understood that many variations and/or modifications of the basic inventive concept taught herein still fall within the spirit and scope of the present invention, as defined by the appended claims.

What is claimed is:

1. A plasma display panel, comprising:

a first substrate affixed to a second substrate;

a plurality of discharge cells arranged between the first and the second substrates to define a display area;

an exhaust aperture included in at least one of the first and the second substrates;

frit arranged around the exhaust aperture, an application area of the frit being on a side of the exhaust aperture closest to the display area being less than an application area of the frit on a side of the exhaust aperture furthest from the display area; and an exhaust tube attached, via said frit, to the at least one of the first and the second substrates to communicate with said exhaust aperture.

2. The plasma display panel of claim 1, wherein a center of the exhaust tube is displaced from a center of the exhaust aperture by a distance.

3. The plasma display panel of claim 2, wherein the center of the exhaust tube is displaced from the center of the exhaust aperture in a direction away from the display area.

4. The plasma display panel of claim 1, wherein the frit is arranged in a donut-shape that surrounds the exhaust aperture.

5. The plasma display panel of claim 4, wherein a first width between inner and outer circumferences of the frit on the side of the exhaust aperture nearest the display area is less than a second width between the inner and outer circumferences of the frit on the side of the exhaust aperture furthest from the display area.

6. The plasma display panel of claim 5, wherein the second width is at least 1.3 times larger than the first width.

7. The plasma display panel of claim 6, wherein the second width is 8 mm.

8. The plasma display panel of claim 6, wherein the first width is 5 mm.

9. The plasma display panel of claim 4, wherein a center of an inner circumference of the frit coincides with a center of the exhaust aperture.

10. The plasma display panel of claim 9, wherein a center of an outer circumference of the frit is displaced from the center of the exhaust aperture in a direction away from the display area.

11. The plasma display panel of claim 4, wherein a first distance between a line tangent to an inner circumference of the frit and a line tangent to an inner circumference of the exhaust tube at the side of the exhaust aperture closest to the display area is less than a second distance between a line tangent to the inner circumference of the frit and a line tangent to the inner circumference of the exhaust tube at the side of the exhaust aperture furthest far away from the display area.

12. A plasma display panel, comprising:

a first substrate affixed to a second substrate;

a plurality of discharge cells arranged between the first and the second substrates to define a display area;

an exhaust aperture included in at least one of the first and the second substrates;

frit arranged around the exhaust aperture, an application area of the frit having a shape of a skewed donut; and an exhaust tube attached, via said frit, to said at least one of the first and second substrates to communicate with said exhaust aperture.

13. The plasma display panel of claim 12, the application area of the frit being skewed in a direction away from the display area.

14. The plasma display panel of claim 12, a center of the exhaust aperture coincides with a center of the inner circumference of the application area of the frit, and a center of the exhaust tube coincides with a center of an outer circumference of the application area of the frit.

15. The plasma display panel of claim 14, the center of the outer circumference of the application area of the frit being displaced a distance in a direction away from the display area from the center of the inner circumference of the application area of the frit.

* * * * *